United States Patent [19]

Nakamura et al.

[11] 4,007,398

[45] Feb. 8, 1977

[54] AUTOMATIC CONTROL DEVICE FOR AN ELECTRONIC FLASH APPARATUS

[75] Inventors: Zenzo Nakamura, Urawa; Shohei Ohtaki, Machida; Takashi Uchiyama, Yokohama; Hideo Yokota, Tokyo, all of Japan

[73] Assignee: Canon Kabushiki Kaisha, Tokyo, Japan

[22] Filed: Aug. 15, 1975

[21] Appl. No.: 604,954

[30] Foreign Application Priority Data

Aug. 27, 1974 Japan ..... 49-98657

[52] U.S. Cl. ..... 315/151; 307/252 M; 315/159; 315/241 P

[51] Int. Cl.[2] ..... H05B 41/32

[58] Field of Search ..... 315/149, 151, 159, 179, 315/190, 193, 241 P; 307/252 M; 354/145, 147

[56] References Cited

UNITED STATES PATENTS 3,809,951 5/1974 Vital et al. ..... 315/151 X 3,835,351 9/1974 Schneider ..... 315/241 P

*Primary Examiner*—Eugene La Roche

*Attorney, Agent, or Firm*—Toren, McGeady and Stanger

[57] ABSTRACT

A device for automatic control of the quantity of light from an electronic flash tube including a silicon controlled rectifier connected in series with the flash tube, a circuit for applying a reverse voltage between the main electrodes of said silicon controlled rectifier so as to open said rectifier, and a switching element connected between said reverse voltage applying circuit and said silicon controlled rectifier. Responsive to the output signal from the reverse voltage applying circuit, the switching element short-circuits the gate electrode and cathode of the rectifier. With this arrangement, it is possible to decrease the capacity of a commutation capacitor constituting part of the reverse voltage applying circuit.

15 Claims, 4 Drawing Figures

AUTOMATIC CONTROL DEVICE FOR AN ELECTRONIC FLASH APPARATUS

BACKGROUND OF THE INVENTION

1. Field of the Invention

This invention relates to an automatic control device for electronic flash apparatus, and more particularly to a switching circuit of the control device.

2. Description of the Prior Art

In general, flash tubes have to flow large current when flash light is produced. To terminate the duration of energization of the flash tube instantaneously has, therefore, been a very difficult problem. A satisfactory solution for this problem is disclosed in U.S. Pat. No. 3,591,829, in which a flash tube is provided with a silicon controlled rectifier connected in series therewith in combination with a commutation capacitor arranged so that when the flash tube is deenergized, an amount of electrical energy previously shared on the commutation capacitor is applied across the main electrodes of the silicon controlled rectifier to open it. A drawback of this arrangement is to require that the commutation capacitor be of large capacity, which in turn calls for an increase in the dimensions of the electronic flash.

SUMMARY OF THE PRESENT INVENTION

An object of the present invention is to provide a control device which has overcome the above mentioned conventional drawback.

Another object of the present invention is to provide a control device having a compact switching circuit.

Another object of the present invention is to provide a control device having a switching element connected to a flash tube and arranged so that after once opened, the switching element is not accidentaly closed again by electrical noise.

Another object of the invention is to provide a control device having a switching circuit in which a high reverse voltage may be applied to a switching element controlling termination of energization of a flash tube.

Other objects of the present invention will become apparent from the following description taken in conjunction with the accompanying drawings in which:

DESCRIPTION OF THE PREFERRED EMBODIMENT

Figure 1:
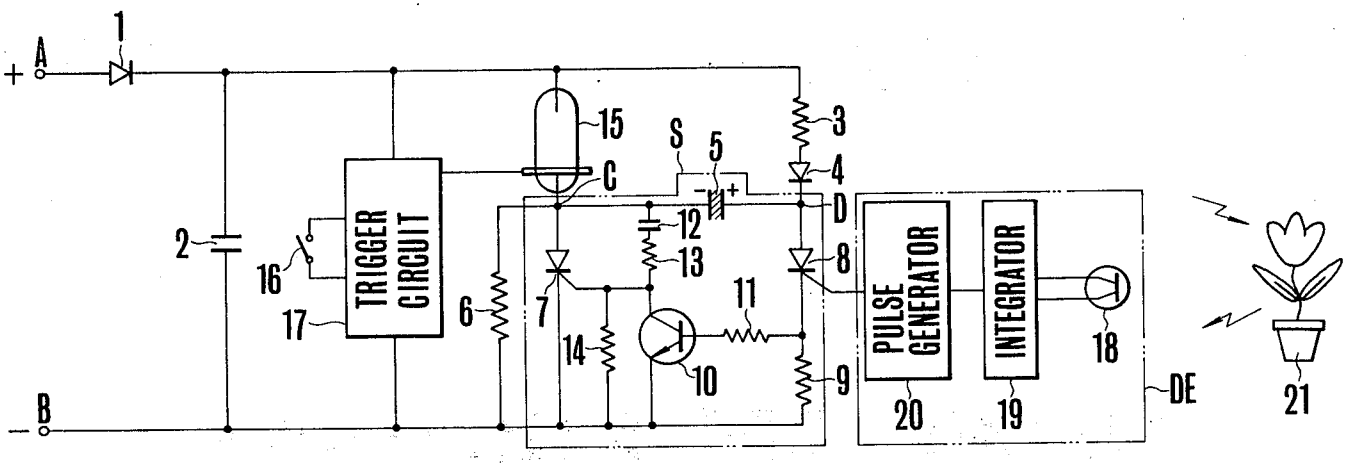
FIG. 1 is a circuit diagram, partially in block form, of one embodiment of an automatic control device according to the present invention applied to an electronic flash apparatus.

FIG. 1 shows a preferred embodiment of an automatic control device according to the present invention. 1 is a rectifier diode connected to a not shown power source, 2 is a main capacitor charging electrical energy which is to be converted to light energy, 3 is a resistor, 4 is a reverse-current preventing diode, 5 is a commutation capacitor charging electrical energy which is to be applied in the form of a reverse voltage between the main electrodes of a silicon controlled rectifier 7 (hereinafter referred to as SCR) connected in series to a flash tube 15, and 6 is a resistor connected in parallel connected to SCR 7, the parts 3, 4 and 6 constituting a circuit for charging the commutation capacitor 5. 8 is a second SCR connected in series with the commutation capacitor 5, and 9 is a resistor for providing at the both ends thereof, a predetermined voltage when the second SCR 8 is closed, the parts 5, 8 and 9 constituting a reverse voltage applying circuit. 10 is a npn-type transistor having a collector electrode connected to the gate electrode of the first SCR 7 and having an emitter connected to the cathode of the first SCR 7 so that the gate electrode and cathode of the frst SCR 7 is short-circuited when the transistor is in the conducting state, 11 is a resistor connected between the base electrode of the transistor 10 and a point on the connection between the second SCR 8 and the resistor 9, 12 is a capacitor connected through a resistor 13 to the collector electrode of the transistor 10, 14 is a resistor connected between the collector and emitter electrodes of the transistor 10, 16 is a trigger switch, and 17 is a trigger circuit for triggering the flash tube 15 when switch 16 is closed, the output terminal of this circuit being connected to the trigger terminal of the flash tube 15. 18 is a photosensitive element such as photo-transistor or silicon photo-cell receptive of the light reflected from an object for producing an electrical signal corresponding to the amount of light reflected, 19 is an integrator for integrating the electrical signal from the photosensitive element 18, and 20 is a pulse generating circuit for producing a terminating signal when the integrated value of the integrator 19 reaches a predetermined level.

Next, the operation of the control device of construction described above will be explained. When the trigger switch 16 is closed, the trigger circuit 17 produces a trigger signal which is applied to the flash tube 15. Upon advent of the trigger pulse on the flash tube 15, a portion of the electrical energy stored on the main capacitor 2 is instantaneously discharged through the flash tube 15, capacitor 12 and resistors 13 and 14, thereby a positive voltage appearing across the resistor 14 causing the first SCR 7 to be rendered conducting. With the cnducting SCR 7, the remaining electrical energy stored on the main capacitor 2 is discharged through the flash tube 15 and the first SCR 7, causing the flash tube 15 to emit flash light with which the object 21 is illuminated. When the amount of light reflected from the object 21 has reached the predetermined level, as it is determined by the photosensitive element 18 and the integrator 19, the pulse generating circuit 20 produces a terminating signal which is applied to the gate electrode of the second SCR 8. Upon advent of this signal, the second SCR 8 is rendered conducting causing the electrical energy on the commutation capacitor 5 to be discharged through the circuit which can be traced from the positive terminal of the commutation capacitor 5 through the second SCR 8, resistor 9 and the first SCR 7 to the negative terminal of the commutation capacitor 5. As a result, a reverse voltage is applied between the main electrodes of the first SCR 7. On the other hand, a positive voltage appears across the resistor 9 causing the transistor 10 to be rendered conducting to short-circuit the gate electrode and cathode of the SCR 7, thereby the potentials of the gate electrode and cathode of the SCR 7 become almost equal to each other. Therefore, the turn-off time of SCR 7 under such a situation is shorter than when the reverse voltage is applied between the main electrodes of SCR 7 by the reverse voltage applying circuit under the condition that the gate electrode and cathode of the SCR 7 is short-circuited, or the potential of the gate electrode of the SCR 7 is higher than that of the cathode thereof. In other words, even when the amount of electrical energy stored on the commutation capacitor is small, it is possible to render the SCR 7 non-conducting. As a result, a capacitor having a small capacity may be selected for employment as the commutation capacitor. After the SCR 7 is rendered non-conducting, the electrical energy on the main capacitor 2 is discharged through the flash tube 15, the commutation capacitor 5, SCR 8 and the resistor 9. At this time, the commutation capacitor 5 is charged to opposite polarity to that before, i.e., to that illustrated in the figure. When the voltage across the commutation capacitor 5 is balanced with that across the main capacitor 2, no more discharge occurs from the main capacitor 2 to terminate the duration of energization of the flash unit 15. It is to be noted that the time interval necessary to completely charge the commutation capacitor 5 is very short. Therefore, the flash tube 15 ceases to emit flash light at a moment almost simultaneous to that at which the generator 20 produces the terminating pulse. Further, it is to be noted that the voltage across the resistor 9 is not changed during the time when the commutation capacitor 5 is charged in the opposite direction. Therefore, the transistor 10 when once turned on continues to maintain the conducting state despite of the fact that the commutation capacitor 5 is charged in the opposite direction. As the transistor 10 is maintained in the conducting state, the potential of the gate electrode of the first SCR 7 is maintained at a level almost equal to that of the cathode thereof to prevent noise when applied to the gate electrode of the SCR 7 from causing the next conduction of the SCR 7.

As described above, according to the first example of the embodiment of the invention, the first SCR 7 is employed in combination of a transistor 10 as arranged to short-circuit the gate and cathode of the SCR 7 when the SCR 7 is turned off by application of the reverse voltage across the main electrodes thereof. This arrangement permits selection of a capacitor of small capacity than was previously necessary for employment as the commutation capacitor, thereby giving an additional advantage of constructing the switching circuit containing parts 5 through 14 in the compact form. Another advantage deriving from the mode of controlling operation of a switching element 10 connected between the gate and cathode of the SCR 7 by the help of a resistor which provides varying voltages as reverse current is applied thereto from the commutation capacitor 5 is to insure that the operation of SCR 7 connected in series to the flash tube is not affected by the noise.

Figure 2:
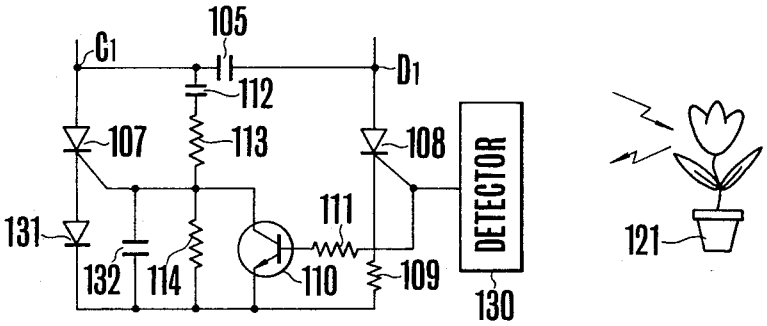
FIG. 2 is a circuit diagram showing an example of a switching circuit constituting the essential part of an automatic control device of the present invention.

In FIG. 2, there is shown a second example of the embodiment of the invention adapted to the purpose of using a transistor of high saturation voltage as the short-circuiting element along with the commutation capacitor which is of small capacity and size. The circuit of FIG. 2 is illustrated as being used in place of the switching circuit of FIG. 1 enclosed by dashed line S constituting part of the control device of the invention. In the figure, the same reference numerals but plus hundred have been employed to denote the similar parts to those shown in FIG. 1. $C_1$ is a terminal to be connnected to the terminal C of FIG. 1, $D_1$ is a terminal to be connected to the terminal D of FIG. 1, 105 is a commutation capacitor, 107 is a first silicon controlled rectifier including main electrodes and a control electrode, 108 is a second silicon controlled rectifier, 109 is a resistor, 110 is a transistor, 111 is a resistor connected between the base electrode of the transistor 110 and the output terminal of a detector 130, 112 is a capacitor, 113 and 114 are resistors, and 121 is an object. The detector 130 comprises a photosensitive element 18, an integrating circuit 19 and a pulse generating circuit 20, the arrangement of these parts 18 through 20 being similar to that shown in FIG. 1. The output terminal of the detector 130 is also connected to the control electrode of the second SCR 108.

The operation of the control device employing the circuit of FIG. 2 will next be explained in connection with FIGS. 1 and 2. The control device is now to be assumed in an operative position where the first SCR 107 is in the conducting state and the flash tube 15 is energized to emit flash light by which the object 121 is illuminated. At this time, the potential of the cathode of the first SCR 107 is higher than that of ground by voltage of, for example, 0.6 volt, because a diode 131 is connected between the cathode of the SCR 107 and ground. When the amount of light received by the photosensitive element 18 has reached a predetermined level, the second SCR 108 is rendered conducting and simultaneously the npn-type transistor is rendered conducting by the control signal from the detector 130. In this case, the first SCR 107 can be short-circuited provided that the saturation voltage Vcesat of the transistor 110 is in a range defined by $Vgk < Vcesat < Vgk + Vd$, wherein $Vgk$ is the voltage between the control electrode and cathode of the first SCR 107, and $Vd$ is the voltage across the diode 131. If the diode 131 is not used, a transistor having a saturation voltage lower than the voltage $Vgk$ must be employed as the switching element 110, or otherwise the first SCR 107 could not be rendered conducting. The use of a transistor of high saturation voltage as the switching element is advantageous from the economical point if view. The operation subsequent to the turning-on of the first SCR 107 is similar to that shown in connection with FIG. 1.

Figure 3:
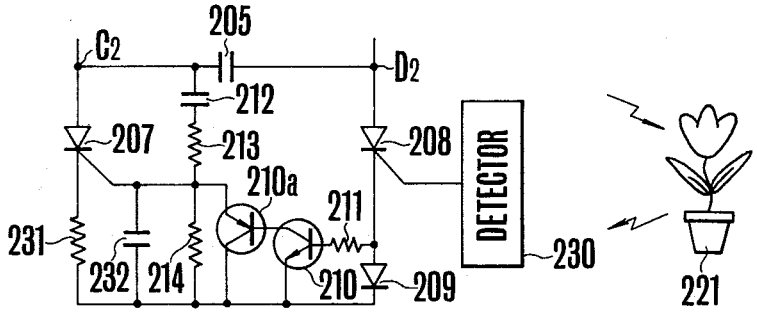
FIG. 3 is a circuit diagram showing another example of a switching circuit constituting the essential part of an automatic control device of the present invention.

In FIG. 3 there is shown a third example of the embodiment of the invention, wherein the switching circuit of FIG. 3 is different from that of FIG. 2 in that a diode 209 is used instead of the resistor 109, a resistor 231 is used instead of the diode 131, and cascade-connected two transistors 210 and **210*a* are used instead of the transistor 110. In FIG. 3, $C_2$ is a terminal to be connected to the terminal C of FIG. 1, $D_2$ is a terminal to be connected to the terminal D of FIG. 1, 205 is a commutation capacitor having an identical function to that of the capacitor 5, 207 and 208 are respectively first and second SCRs having identical functions to those of the SCRs 7 and 8 each having two current carrying electrodes and a control electrode, 210 and 210*a* are npn-type and pnp-type transistors respectively having an identical function to that of the transistor 10, 212, 213, 214 are a capacitor and resistors having identical functions to those of the capacitor 12 and resistors 13 and 14 respectively, 230 is a detector having an identical function to that of 130, 213 is a resistor having an identical function to that of 131, and 232** is a capacitor.

The operation of the circuit of FIG. 3 is as follows. Upon advent of a signal from the detector 230, the second SCR 208 is rendered conducting causing the electrical energy stored on the commutation capacitor 205 to be applied through the SCR 208 and diode 209 to the main electrodes of the first SCR 207 in the opposite direction. A voltage produced across the diode 209 renders the transistors 210 and 210*a* conducting thereby, the control electrode and cathode of the first SCR 207 are short-circuited, while reverse voltage being applied to the main electrodes of the first SCR 207. Therefore, the first SCR 207 is turned off in a short time interval. During this operation, almost all of the electrical energy stored on the capacitor 205 is applied to the main electrodes of the first SCR 207 in the form of a reverse voltage because the voltage across the diode 209 is as low as 0.6 volts. As a result, a high reverse voltage is applied between the main electrodes of the first SCR 207, and therefore, the period of conduction of the first SCR 207 is decreased from that effected in the circuit of FIG. 1, to decrease the amount of residual flash light.

Figure 4:
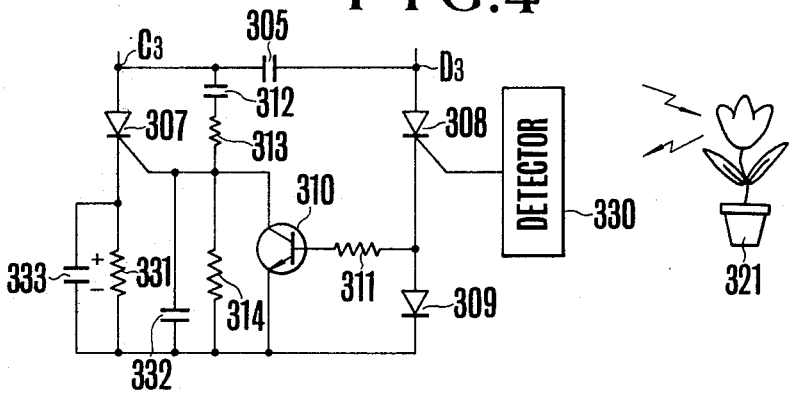
FIG. 4 is a circuit diagram showing still another example of a switching circuit constituting the essential part of an automatic control device of the present invention.

In FIG. 4, there is shown a fourth example of the embodiment of the invention, wherein the switching circuit is almost similar in construction to that of FIG. 3, and therefore, the same reference numerals but each added by three hundred have been employed to denote the similar parts to those of FIG. 3. The circuit of FIG. 4 is different from that of FIG. 3 in that a capacitor 333 is employed for connection between ground and the cathode of the first SCR 307. The operation of the switching circuit of FIG. 4 will next be explained in connection with FIG. 1. When the first SCR 307 is turned on, a voltage is produced across the resistor 331, and also the voltage across the capacitor 333 is gradually increased. Upon advent of a signal from the detector 330, the second SCR 308 is rendered conducting to apply the electrical energy stored on the capacitor 305 to the first SCR 307 through the diode 309. A voltage produced across the diode 309 renders the transistor 310 conducting to short-circuit the control electrode and cathode of the first SCR 307. In this example, the electrical energy stored on the capacitor 333 is also discharged through the cathode and control electrode of the first SCR 307, thereby the cathode and control electrode of the first SCR 307 are not only short-circuited but supplied with reverse voltage. As a result, the period of conduction of the first SCR 307 is further decreased from that of the third example.

As will be seen from the foregoing description according to the present invention, the SCR connected in series to the flash tube is short-circuited in synchronism with the signal from the detector, thereby it being made possible to use a commutation capacitor of small capacity. This will call for a decrease in the dimensions of the flash apparatus employing the control device of the invention.

The SCR connected in series to the flash tube is provided with an impedance element such as diode or resistor as connected between the cathode of the SCR and ground to permit the use of a transistor of high saturation voltage, in other words, an inexpensive transistor as the short-circuiting element. In addition to the above mentioned advantage, therefore, the flash apparatus can be manufactured at low cost.

Further, the operation of the short-circuiting transistor is controlled by the use of a diode. This feature permits the electrical energy stored on the commutation capacitor to be applied to the SCR connected in series to the flash tube without causing any loss thereof. For this reason, the present invention facilitates a further decrease in the capacity of the commutation capacitor from that necessary when the SCR connected in series to the flash tube is short-circuited merely at the main electrodes thereof.

What is claimed is:

1. An automatic control device for an electronic flash apparatus comprising:

a. detecting means including photosensitive means and producing a first control signal in response to a predetermined amount of light incident on said photosensitive means, b. storage capacitor means, c. first switching means including a control electrode and two main current carrying electrodes having an anode electrode and a cathode electrode, d. a flash tubc connected in series to said first switching means, said flash tube and first switching means constituting a circuit which is connected to said storage capacitor, e. means for firing said flash tube, f. a reverse voltage circuit including commutation capacitor means and second switching means being actuable to a closed condition in response to said first control signal and connected in series to said commutation capacitor means across the main electrodes of said first switching means, the reverse voltage circuit applying a reverse voltage between the main electrodes of said first switching means, g. voltage generating means connected to said reverse voltage circuit and producing a second control signal in response to the closing of said second switching means, and h. shunt circuit means having an input terminal connected to said voltage generating means and responsive to said second control signal for short-circuiting the control electrode and cathode of said first switching means.

2. A device according to claim 1, wherein said shunt circuit means is a third switching means having an input terminal connected to said voltage generating and an output terminal connected to a point on the connection between the control electrode and the cathode of said switching means.

3. A device according to claim 2, wherein said third switching means is a transistor.

4. A device according to claim 2, wherein said third switching means comprises two transistors cascade-connected with each other.

5. A device according to claim 1, wherein said voltage generating means includes an impedance means.

6. A device according to claim 5, wherein said voltage generating means is provided with a diode connected in series to a circuit containing said commutation capacitor means and said second switching means series-connected with each other.

7. A device according to claim 5, wherein the impedance means of said voltage generating means is a resistor.

8. A device according to claim 7, wherein said resistor of said voltage generating means is connected in series to a circuit containing said commutation capacitor and said second switching means series-connected with each other.

9. An automatic control device for an electronic flash apparatus comprising:

a. detecting means including photosensitive means and producing a first control signal in response to a predetermined amount of light incident on said photosensitive means, b. storage capacitor means, c. a first silicon control rectifier including a control electrode and two main current carrying electrodes having an anode electrode and a cathode electrode, d. a flash tube connected in series to said silicon controlled rectifier, said series circuit comprising said first silicon controlled rectifier and said flash tube being connected in parallel to said storage capacitor means, e. means for firing said flash tube, f. commutation capacitor means, g. means for charging said commutation capacitor means, h. a second silicon controlled including a control electrode and two main current carrying electrodes, said second silicon controlled rectifier being actuable to a closed condition in response to said control signal and connected in series to said commutation capacitor means across the main electrodes of said silicon controlled rectifier whereby to apply a reverse voltage between said first silicon controlled rectifier to open said first silicon controlled rectifier in response to the said closing of the second silicon controlled rectifier, i. impedance means connected in a circuit containing said commutation capacitor means and said second silicon controlled rectifier series-connected with each other and responsive to the closing of said second silicon controlled rectifier for producing a second control signal, and j. switching means having an input terminal connected to said impedance means and responsive to said second control signal for short-circuiting the control electrode and cathode of said first silicon controlled rectifier.

10. An automatic control device for an electronic flash apparatus comprising:

a. control circuit means for producing a control signal, b. storage capacitor means, c. first switching means including a control electrode and two main current carrying electrodes having an anode electrode and a cathode electrode, d. a flash tube connected in series to said first switching means, said flash tube and said first switching means constituting a circuit which is connected to said storage capacitor, e. means for firing said flash tube, f. a reverse voltage applying means including commutation capacitor means and applying a reverse voltage between the main electrodes of said first switching means so as to open the first switching means, g. voltage generating means connected to said reverse voltage circuit and producing a second control signal in response to the closing of said second switching means, and h. shunt circuit means having an input terminal connected to said voltage generating means and responsive to connected to said voltage generating means and responsive to said second control signal for short-circuiting the control electrode and cathode of said first switching means.

11. A device according to claim 10, further including impedance means connected between the cathode electrode of said first switching means and ground to provide a voltage of predetermined value at the cathode of said first switching means.

12. A device according to claim 11, wherein said impedance means is a diode.

13. A device according to claim 11, wherein said impedance means is a resistor.

14. A device according to claim 11, further including means for applying a reverse bias to the control electrode of said first switching means in response to the closing of said second switching means.

15. A device according to claim 14, wherein said reverse bias applying means is connected in parallel with said impedance means.

* * * * *